United States Patent [19]

Leopoldi

[11] Patent Number: 4,877,277

[45] Date of Patent: Oct. 31, 1989

[54] LEVER ADAPTER FOR DOOR KNOBS

[75] Inventor: Norbert Leopoldi, Chicago, Ill.

[73] Assignee: The Cloverline, Inc., Chicago, Ill.

[21] Appl. No.: 246,333

[22] Filed: Sep. 19, 1988

[51] Int. Cl.[4] ..... E05C 21/00

[52] U.S. Cl. ..... 292/347; 292/1; 292/336.3

[58] Field of Search ..... 292/336.3, 347, 1; 135/65–75

[56] References Cited

U.S. PATENT DOCUMENTS

| | | | |
|---|---|---|---|
| 1,503,393 | 7/1924 | Twardowsky | 292/DIG. 71 X |
| 1,650,398 | 11/1927 | Swem | 292/DIG. 71 X |
| 2,192,766 | 3/1940 | Cederstrom | 135/71 |
| 2,699,353 | 1/1955 | Nagy et al. | 292/347 X |
| 3,960,396 | 6/1976 | Miyahara | 292/347 |
| 4,223,931 | 9/1980 | Neary | 292/347 |
| 4,783,883 | 11/1988 | Syalay | 292/347 X |
| 4,787,405 | 11/1988 | Karwoski | 135/68 |

*Primary Examiner*—Richard E. Moore

*Attorney, Agent, or Firm*—Milton S. Gerstein

[57] ABSTRACT

A lever adapter for use with door knobs for aiding arthritic patients in rotating the door knob. The lever adapter is attached to the door knob by a concave, arcuate member having a layer of adhesive. Pulling upon on or pushing down on the lever adapter will cause the simultaneous rotation of the door knob in one direction or the other, whereby linear motion is converted to rotary, in order to obviate the pain and discomfort associated with the turning of a door knob by arthritic persons.

8 Claims, 2 Drawing Sheets

LEVER ADAPTER FOR DOOR KNOBS

BACKGROUND OF THE INVENTION

The present invention invention is directed to an adapter for use with door knobs in order to make rotating the door knob easier for arthritic persons, and the like. Arthritic persons have difficulty in grasping a door knob and rotating it in order to open a door. The present invention provides a retrofitting device that allows for simple pushing down of a lever to replace the necessity of rotating the door knob.

SUMMARY OF THE INVENTION

The present invention has a lever which at one end of which is provided with a concave recess which is provided with a layer of adhesive, or the like, for securing that end to a door knob. The other end of the lever is thereafter used for rotating the door knob in the desired direction by simply pushing down on or pulling up on that other end of the lever. In one embodiment, a series of indentations are provided on one edge surface of the lever for receiving therein the fingers of the hand, to provide better gripping. In a second embodiment, the lever is comprised of inner hard core surrounded by an outer rubber-like layer that is squeezable, in order to allow for a more comfortable gripping of the lever, as well as to allow for the exercising of the hand of the arthritic person.

BRIEF DESCRIPTION OF THE DRAWING

The invention will be more readily understood with reference to the accompanying drawing, wherein.

DETAILED DESCRIPTION OF THE INVENTION

Figure 1:
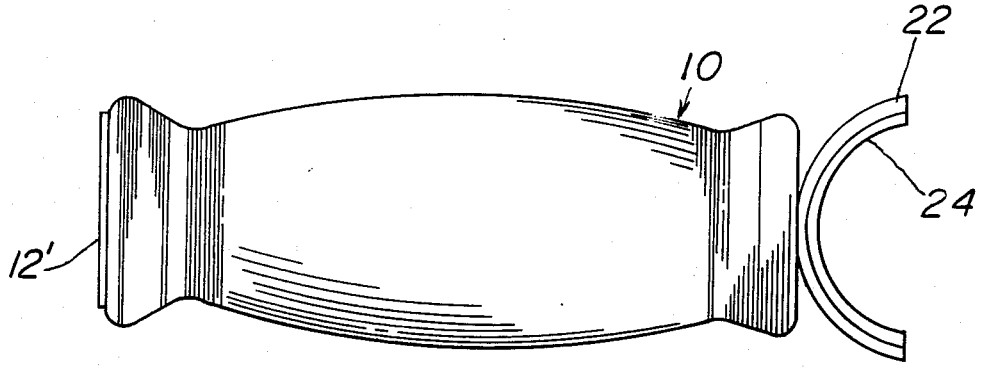
FIG. 1 is a top view of the lever adapter of the invention according to the first embodiment thereof.
Figure 2:
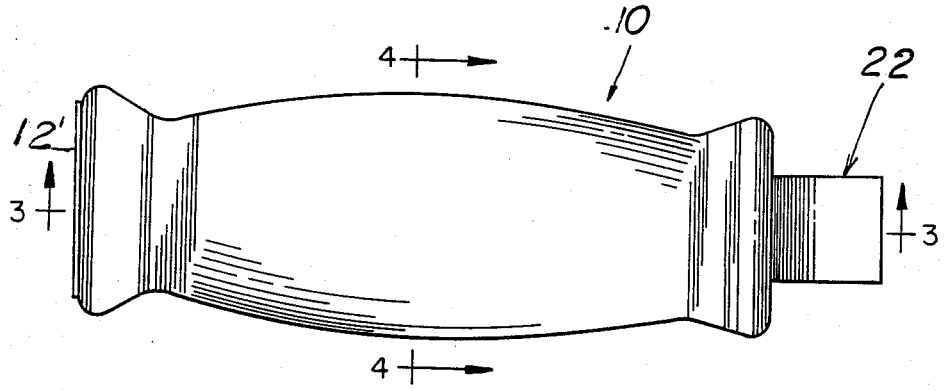
FIG. 2 is a side elevational view thereof.
Figure 3:
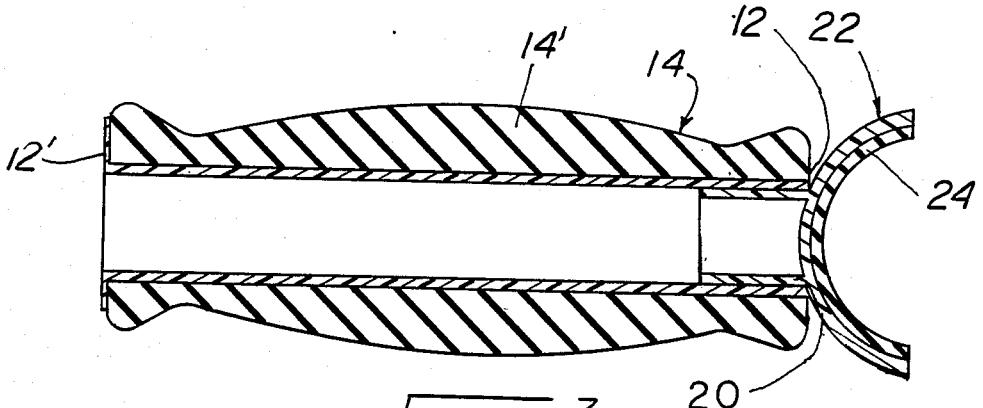
FIG. 3 is a cross-sectional view taken along line 3—3 of FIG. 2.
Figure 4:
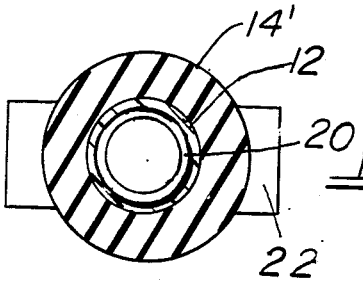
FIG. 4 is a cross-sectional view taken along line 4—4 of FIG. 2.

Referring now to the drawings in greater detail, a lever adapter 10 according to the first embodiment is shown in FIGS. 1–4. The lever adapter 10 has a central elongated core 12 which is preferably made of hard plastic formed into a hollow cylinder. Concentrically mounted about the inner core 12 is an outer rubber-like, soft, squeezable layer 14, which outer layer defines a central bulging area 14' for fitting i inside the palm of a hand, so that an arthritic patient using the lever adapter 10 may, firstly, find a comfortable grip, and, secondly, allow for the patient to exercise his or her hand by continually squeezing the outer layer 14. The central bulging area tapers at the ends of the later 14, so that the entire contour of the rubber-like outer padding or layer conforms to the palm of the hand when clenched. The outer layer is secured adhesively to the inner core, with the inner core defining a flanged end 12' preventing the escape of the outer padding therefrom. The other, door-knob-side end of the inner core received therein a sleeve 20 fixedly and integrally secured to a concave, arcuate member 22. This concave member 22 is provided with an inner layer 24 of conventional adhesive material, by which the concave member and the entire lever adapter 10 are secured to a door knob. The radius of curvature of the arcuate member 22 is approximately the same as the radius of curvature of a conventional door knob, in order to provide a sure fit therebetween. When the lever adapter 10 is secured to a door knob, the door knob may be rotated by simply pulling up on or pushing down on the lever adapter, thereby substantially converting linear movement to rotary, to thereby obviate the need for the arthritic patient to grasp the door knob.

Figure 5:
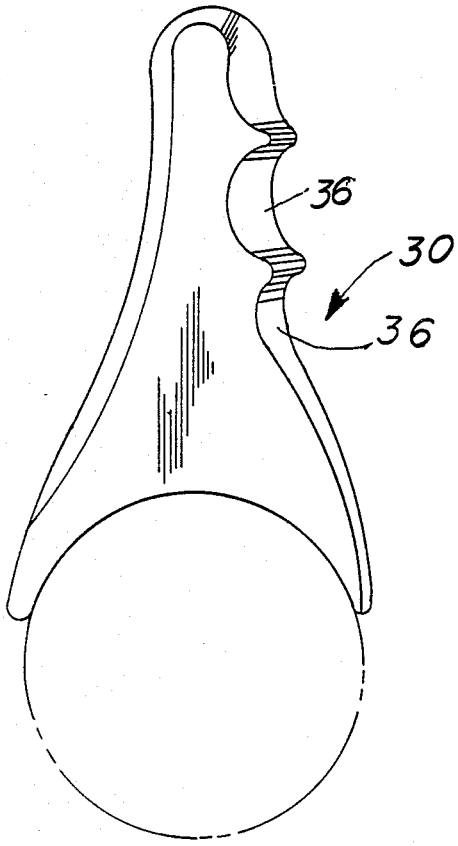
FIG. 5 is an isometric view of the lever adapter of the invention according to the second embodiment thereof.
Figure 6:
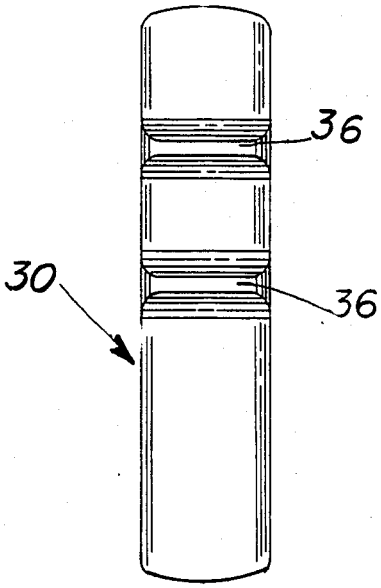
FIG. 6 is a side elevational view thereof.
Figure 7:
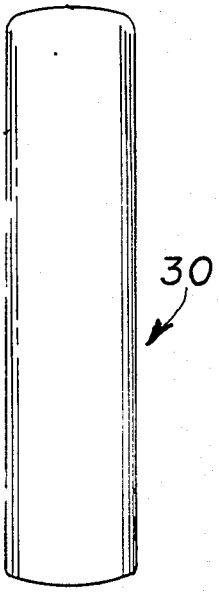
FIG. 7 is another side elevational view thereof.
Figure 8:
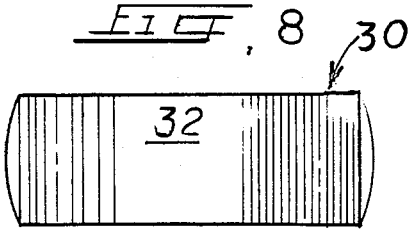
FIG. 8 is a bottom view thereof.
Figure 9:
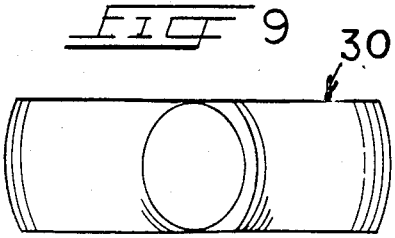
FIG. 9 is a top view thereof.

FIGS. 5–9 show a second embodiment of the lever adapter 30. The lever adapter 30 is made of one piece, molded hard plastic and defines an arcuate end 32 which is provided with an adhesive layer, as in the first embodiment, for securing the lever adapter 30 to a door knob, as shown in FIG. 5. The lever adapter 30 is provided with a series of indentations 36 in which are received the fingers of the hand of an arthritic patient in order to aid in the gripping of the lever adapter. The lever adapter 30 is used in the same manner as the lever adapter 10 for rotating a door knob.

While a specific embodiment of the invention has been shown and described, it is to be understood that numerous changes and modifications may be made therein without departing from the scope, spirit and intent of the invention as set forth in the appended claims.

What I claim is:

1. A lever adapter for use with a door knob for converting linear movement of a hand to the rotary movement of the door knob, comprising:

an elongated lever having a first end and a second end;

said second end comprising a concave, arcuate member having a radius of curvature conforming to the radius of curvature of a door knob, and a layer of means for securing said arcuate member to a door knob;

said elongated lever comprising an inner core member, and an outer, soft rubber-like member concentrically mounted about said inner core, whereby a hand may squeeze said lever.

2. The lever adapter according to claim 1, wherein said layer of means for securing comprises an adhesive layer.

3. The lever adapter according to claim 1, wherein said lever comprises a plurality of indentations formed in an outer surface portion thereof in to which fingers of a hand may be inserted to aid in gripping said lever.

4. The lever adapter according to claim 3, wherein said lever is made of hard plastic.

5. The lever adapter according to claim 1, wherein said outer member defines a circular cross-section and comprises a central bulging area at which a hand may grip said outer member.

6. The lever adapter according to claim 5, wherein said outer member comprises a pair of tapering sections, one said tapering section connecting one end of said central bulging area to a first end of said outer member, and the other of said tapering sections connecting the other end of said central bulging area to a second end of said outer member, said tapering sections each defining a substantially frusto-conical section, whereby said outer member is shaped to fit inside the palm of a hand gripping said lever.

7. The lever adapter according to claim 6, wherein said first end of said lever comprises an enlarged flange member for preventing the escape of said outer member therepast.

8. The lever adapter according to claim 1, in combination with a door knob, said lever being secured to said door knob by said arcuate member.

* * * * *